US010060187B2

(12) United States Patent
Roodenburg et al.

(10) Patent No.: US 10,060,187 B2
(45) Date of Patent: Aug. 28, 2018

(54) TOP DRIVE WELL DRILLING INSTALLATION

(71) Applicant: ITREC B.V., Schiedam (NL)

(72) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 331 days.

(21) Appl. No.: 14/888,583

(22) PCT Filed: Mar. 3, 2014

(86) PCT No.: PCT/NL2014/050127

§ 371 (c)(1),
(2) Date: Nov. 2, 2015

(87) PCT Pub. No.: WO2014/178709

PCT Pub. Date: Nov. 6, 2014

(65) Prior Publication Data

US 2016/0090786 A1 Mar. 31, 2016

(30) Foreign Application Priority Data

May 3, 2013 (NL) ..... 2010756

(51) Int. Cl.
*E21B 3/02* (2006.01)
*E21B 19/06* (2006.01)
*E21B 15/00* (2006.01)

(52) U.S. Cl.
CPC ..... *E21B 3/02* (2013.01); *E21B 15/00* (2013.01); *E21B 19/06* (2013.01)

(58) Field of Classification Search
CPC ..... E21B 15/00; E21B 3/02; E21B 19/06
See application file for complete search history.

(56) References Cited

U.S. PATENT DOCUMENTS 3,857,450 A 12/1974 Guier
4,449,596 A * 5/1984 Boyadjieff ..... E21B 19/16 166/77.52

(Continued)

FOREIGN PATENT DOCUMENTS

EP 0 162 000 A1 11/1985

*Primary Examiner* — Matthew R Buck
*Assistant Examiner* — Aaron L Lembo
(74) *Attorney, Agent, or Firm* — Birch, Stewart, Kolasch & Birch, LLP

(57) ABSTRACT

A top drive well drilling installation comprising a drilling tower, vertical rails supported by the drilling tower, a trolley guided along said one or more vertical rails, and a hoisting device for moving the trolley up and down. The installation further comprises a tubular stem which is to be connected to the upper end of a drill string for rotation therewith about an axis of the drill string, and a top drive unit including a motor adapted to rotate the tubular stem and thereby the connected drill string to drill a well, wherein the top drive unit is supported by the trolley. Furthermore an elevator is provided which is adapted to—in an operative position—suspend the drill string, e.g. during tripping, and an elevator support assembly is provided which is adapted to absorb the load of the suspended drill string and adapted to move the elevator between an operative position on the drill string axis and a retracted position. According to the present invention, the elevator support assembly is embodied as a direct drill string load bearing connection between the elevator and the trolley, independent from the top drive unit.

25 Claims, 10 Drawing Sheets

(56) References Cited

U.S. PATENT DOCUMENTS

| | | | | |
|---|---|---|---|---|
| 4,489,794 | A | 12/1984 | Boyadjieff | |
| 4,800,968 | A * | 1/1989 | Shaw | E21B 19/02 166/66.5 |
| 5,503,234 | A * | 4/1996 | Clanton | E21B 19/02 175/162 |
| 6,920,926 | B2 * | 7/2005 | York | E21B 19/084 166/77.1 |
| 7,073,598 | B2 * | 7/2006 | Haugen | E21B 19/00 166/380 |
| 8,733,454 | B2 * | 5/2014 | Bouligny | E21B 19/07 166/380 |
| 8,960,324 | B2 * | 2/2015 | Holliday | E21B 19/06 166/250.01 |
| 9,051,788 | B2 * | 6/2015 | Hofste | E21B 19/08 |
| 9,376,873 | B2 * | 6/2016 | Moss | E21B 19/06 |
| 2006/0191689 | A1 | 8/2006 | Severin et al. | |
| 2012/0152619 | A1 * | 6/2012 | Hofste | E21B 19/06 175/57 |
| 2012/0160517 | A1 | 6/2012 | Bouligny et al. | |
| 2012/0292010 | A1 * | 11/2012 | Haugen | E21B 19/00 166/77.53 |
| 2016/0237764 | A1 * | 8/2016 | Jellison | E21B 37/02 |
| 2017/0016285 | A1 * | 1/2017 | Pratt | E21B 19/06 |

* cited by examiner

TOP DRIVE WELL DRILLING INSTALLATION

The present invention relates to a top drive well drilling installation and a method for performing well drilling operations.

For example U.S. Pat. No. 4,489,794 discloses with reference to FIGS. 8-10 thereof a top drive well drilling installation comprising a drilling tower that is provided with vertical rails supported by the drilling tower. A trolley is guided along the vertical rails. The trolley is suspended from a travelling block of a hoisting device, commonly referred to as drawworks in the drilling industry. The hoisting device comprises a cable and a winch, as well as a crown block. The travelling block is suspended from the crown block by the cable. Operation of the winch allows to move the travelling block and the trolley up and down along the rails.

The mentioned known installation further comprises a top drive unit including a rotatable tubular stem that is to be connected to the upper end of a drill string for rotation therewith about an axis of the drill string. The top drive unit further includes a motor adapted to rotate the tubular stem and thereby the connected drill string to drill a well. The top drive unit is supported by the trolley, at least so as to absorb reaction torque from the motor of the top drive unit.

In order to suspend the drill string, e.g. when it is detached from the tubular stem and/or the top drive, the mentioned known installation comprises an elevator that is adapted to suspend the drill string there form, e.g. during tripping.

In this known installation, as is rather common in the field, the elevator is held by two pivotable arms, which at their upper end are pivotally connected to a suspension body that is in turn suspended on a shoulder formed on the rotatable tubular stem of the top drive unit. These arms or links as they are often called, are very robust as they are designed to absorb the load of the entire drill string during activities such as tripping. An actuator is provided that is operable to move the elevator between an operative position on the drill string axis and a retracted position away from the drill string axis.

The known arrangement is not entirely satisfactory. For example, as explained in U.S. Pat. No. 4,489,794, the suspension of the elevator from the rotatable stem requires a mechanism to avoid that the pivotable arms holding the elevator are entrained in the rotary motion of the tubular stem during drilling. Otherwise the risk exists that the arms and elevator would swing around.

It is therefore an object of the first aspect of the present invention to propose an improved installation or at least an alternative installation.

The first aspect of the present invention provides an installation according to the preamble of claim 1, which is based on U.S. Pat. No. 4,489,794, which is characterized in that the elevator support assembly is embodied as a direct drill string load bearing connection between the elevator and the trolley, independent from the top drive unit.

The inventive design allows, in embodiments, to achieve relevant advantages over the prior art designs.

For example the top drive unit now does not need to be designed to support the elevator, making its design less complex and costly.

Also the top drive unit needs not be tailored to the elevator, or vice versa.

According to the first aspect of the invention, the top drive unit is supported by the trolley, at least so as to absorb reaction torque from the motor of the top drive unit. The trolley is suspended from the hoisting device. It is equally conceivable that the top drive unit is suspended from the trolley, or that the top drive unit is suspended from the hoisting device, for example a travelling block, and only supported by the trolley to absorb reaction torque. Hence, the top drive is suspended from the hoisting device, optionally via the trolley.

According to the first aspect of the invention, the tubular stem is to be connected to the upper end of a drill string for rotation therewith about an axis of the drill string. In an embodiment, the tubular stem is connected to or formed integral with the top drive unit. As the top drive unit is supported by the trolley, the tubular stem is thus supported by the trolley via the top drive unit. In an alternative embodiment, the tubular stem is directly connected to the trolley, in a manner allowing rotation of the tubular stem. In both embodiments, the top drive unit is allowed to engage on the tubular stem to rotate the tubular stem and thereby the connected drill string to drill the well.

In a possible embodiment, the top drive unit is formed integral with the trolley.

Alternatively, the top drive unit is suspended in a detachable manner. For example, in an embodiment, the hoisting device, e.g. a travelling block of the hoisting device, supports a hook, and the top drive unit is provided with a bail so as to suspend the top drive unit from the hook. Such a detachable top drive unit enables the top drive unit to be removed from the trolley, whilst the elevator still is fully functional. This may, e.g., be of use to conduct maintenance or repairs on the top drive unit during tripping of the drill string. The top drive can then simply be removed, and tripping can nonetheless be effected. In addition, it is possible to provide a substitute top drive, and to allow the top drive well drilling installation of the invention for an exchange of the top drives. In an embodiment, wherein the top drive is suspended in a detachable manner from the hoisting device, optionally via the trolley, a method according to the present invention can be carried out, comprising the following steps:

- well drilling by the top drive unit,
- detaching the drill string from the tubular stem and/or the top drive,
- attaching the drill string to the elevator,
- detaching the top drive from the hoisting device or the trolley,
- tripping the drill string.

In an embodiment, the top drive well drilling installation is furthermore provided with a top drive hoisting device for suspending the top drive and adapted to remove the top drive from the operative position on the drill string axis. Possibly, the hoisting device for moving the trolley up and down extends adjacent the drill string axis, allowing the top drive hoisting device to engage the top drive within the drill string axis. The top drive hoisting device can e.g. be a conventional crane.

Also any electronic devices, e.g. one or more sensors, on the elevator (e.g. to signal the opened and/or closed state of the elevator, or to signal the presence of a tubular in the elevator) can be connected via one or more cables that can be run, e.g. via drag chains, along the elevator support assembly, thereby bypassing the top drive unit. This again avoids undue coordination between the design of the top drive unit and the elevator.

According to the first aspect of the invention, the elevator support assembly is embodied as a direct drill string load bearing connection between the elevator and the trolley, independent from the top drive unit. Hence, the elevator support assembly is connected to the trolley, while the top drive unit is also supported by the trolley. Possibly, the connection point of the elevator support assembly is provided above the tubular stem. In an embodiment, the connection point of the elevator support assembly is provided above the motor of the top drive unit.

In an embodiment, the elevator support assembly comprises two pivotal first arms connected at an upper end thereof to the trolley, the first arms being arranged on opposed sides of the top drive unit so as to pass along the top drive unit when moving the elevator between the operative and retracted position. Optionally, the first arms are freely rotatable suspended at their upper end so as to hang down under influence of gravity.

In an embodiment, the two pivotal first arms are mutually connected, e.g. via one or more cross beams, e.g. forming a U-shaped cage surrounding the top drive unit. Optionally, a cross beam is connected to the lower ends of the first arms, said cross beam supporting the elevator.

In an embodiment, the elevator support assembly comprises one or more actuators, e.g. hydraulic cylinders, between the trolley and one or more of the pivotal arms, e.g. between each first arm and the trolley, to move the elevator between the operative position on the drill string axis and a retracted position.

Preferably, the pivotal arms are aligned on a vertical line below the pivot of the first arm in a common imaginary plane with the drill string axis in the operative position. In the retracted position, the pivotal arms may have pivoted away from the vertical line, with an angle between 10-90°, preferably between 15-45°.

In an embodiment, the elevator support assembly comprises two pivotal second arms, each connected at an upper end thereof pivotally to a lower end of a corresponding first arm, wherein the elevator is connected to a lower end of the second arms. Possibly, a cross beam is connected to the lower ends of the second arms, said cross beam supporting the elevator.

In an embodiment, the elevator support assembly is provided with one or more storage locations for drilling equipment, such as spare or alternative elevators. Preferably at least two storage locations are provided at opposite sides of the elevator. In an embodiment where the elevator support assembly comprises a cross beam, e.g. between the pivotal first arms or between the pivotal second arms, the cross beam possibly provides storage locations, e.g. for alternative elevators, at opposite sides of the elevator.

In an embodiment, the elevator support assembly comprises one or more actuators, e.g. hydraulic cylinders, between the trolley and one or more of the pivotal first arms, to move the elevator between the operative position on the drill string axis and a retracted position. The second arms may be freely rotatable suspended at their upper end so as to hang down under influence of gravity.

Preferably,—in the operative position of the elevator—the interconnected pivotal first and second arms of each pair of pivotal arms are aligned on a vertical line below the upper pivot of the first arm, the straight line being in a common imaginary plane with the drill string axis. In the retracted position, the first pivotal arms may have pivoted away from the vertical line, with an angle between 10-90°, preferably between 15-45°, while the second pivotal arms may be allowed to hang down under influence of gravity from the first pivotal arms.

In an alternative embodiment, the elevator support assembly comprises two pivotal first arms connected at an upper end thereof to the trolley, and at the lower ends being interconnected by a cross beam. To the cross beam a pair of pivotal elevator arms supporting the elevator is connected. Preferably, one or more actuators, e.g. hydraulic cylinders, are provided between the trolley and one or more of the pivotal first arms, to move the elevator between the operative position on the drill string axis and a retracted position. The cross beam may be freely rotatable suspended from the pivotal first arms so as to hang down under influence of gravity.

In the operative position of the elevator the pivotal first arms and elevator arms of each pair of arms are aligned on a vertical line below the upper pivot of the first arm, the straight line being in a common imaginary plane with the drill string axis.

Different types of elevators may be provided in the top drive well drilling installation of the invention, e.g. elevators adapted to suspend drill string, casings, liners, etc. etc.

In an embodiment, the cross beam between the first pivotal arms is essentially horizontal, and two pairs of pivotal elevator arms are movable along the cross beam between an operative position and a first and second parking position, the pivotal elevator arms each supporting an elevator, wherein—in the operative position of an elevator—the corresponding pair of elevator arms is aligned on a vertical line in a common imaginary plane with the drill string axis and the elevator is aligned with the drill string axis, while the other pair of elevator arms is positioned in a parking position. It is conceivable that the elevator supported by the elevator arms in the parking position remains operable, e.g. allowing tubulars to be attached to the elevator.

Preferably, the operative position is provided centrally on the cross beam, while the parking positions are provided at the ends of the cross beam. The cross beam is e.g. provided with rails along which the pair of elevator arms is moveable, e.g. via a trolley. For example, hydraulic cylinders are provided to move the elevator arms.

The provision of two pairs of elevator arms allows to disassemble and assemble an elevator to the pair of elevator arms at the parking position, while the other pair of elevator arms supports the elevator in an operational position. This is advantageous when different types of elevators are required in a process, in particular when switching between types of elevators is required, e.g. elevators for drill pipes and elevator for casings. The embodiment with two pairs of elevator arms, each adapted to support an elevator, allows an efficient switch between two types of elevators which may attribute to the overall process efficiency.

In a possible method wherein use is made of an installation according to claim 16, and wherein a rotary table is provided to hang off a string of tubulars, the method comprising the following steps:

- lowering casing via the first pair of elevator arms and a first elevator in the operative position, while the second pair of elevator arms and the second elevator are in the second parking position,
- hanging off the casing string in the rotary table,
- moving the first pair of elevator arms to the first parking position and the second pair of elevator arms and second elevator from the second parking position to the operative position,
- lowering drill pipes via the second pair of elevator arms and second elevator.

It is noted that alternative clamps and the like may be applied to hang of a string of tubulars.

Depending on the operation, the string of tubulars may comprise casings or drill pipes, e.g. used as landing string.

In an embodiment, the elevator comprises at least one mobile elevator body member so as to cause an opened and closed state of the elevator, wherein—in the opened state—the elevator can be placed about a section of drill string or drill pipe and removed therefrom, and wherein—in the closed state—the elevator engages on the drill string or drill pipe so as to suspend said drill string or drill pipe from the elevator.

Optionally, the elevator comprises a sensor indicating the opened and/or closed state of the elevator, and wherein a sensor cable is provided that extends along the elevator support assembly to the trolley. Preferably, also a sensor and sensor cable are provided to indicate the presence of a tubular in the elevator.

In an embodiment, a wrench device is provided which is connected to the top drive unit for making and breaking connections between the tubular stem and the drill string. Preferably, the wrench device is adapted for horizontal and vertical motion relative to the tubular stem.

According to the invention, a hoisting device is provided for moving the trolley up and down. The hoisting device may be of a Ram Rig-type, or alternatively comprise a rack-and-pinion. In an embodiment, the hoisting device comprises a cable and a winch, a crown block, and a travelling block suspended from the crown block by said cable, wherein the trolley is suspended from the travelling block so as to move up and down upon operation of the winch.

A second aspect of the invention relates to a top drive well drilling installation comprising:

- a drilling tower,
- one or more vertical rails supported by the drilling tower,
- a trolley guided along said one or more vertical rails,
- a hoisting device for moving the trolley up and down,
- a tubular stem which is to be connected to the upper end of a drill string for rotation therewith about an axis of the drill string,
- a top drive unit including a motor adapted to rotate the tubular stem and thereby the connected drill string to drill a well, wherein the top drive unit is supported by the trolley, at least so as to absorb reaction torque from the motor of the top drive unit,
- an elevator adapted to—in an operative position—suspend the drill string, e.g. during tripping,
- an elevator support assembly adapted to absorb the load of the suspended drill string and adapted to move the elevator between the operative position on the drill string axis and a retracted position.

As indicated above, such an installation is known e.g. from U.S. Pat. No. 4,489,794. It is an object of the second aspect of the present invention to propose an improved installation or at least an alternative installation.

According to the second aspect, the present invention provides an installation according to the preamble of claim 16, which is based on U.S. Pat. No. 4,489,794, which is characterized in that the elevator support assembly comprises an essentially horizontal cross beam along which two pairs of pivotal elevator arms are movable between an operative position and a first and second parking position, the pivotal elevator arms each adapted to support an elevator, wherein—in the operative position of an elevator—the corresponding pair of elevator arms is aligned on a vertical line in a common imaginary plane with the drill string axis and the elevator is aligned with the drill string axis, while the other pair of elevator arms is positioned in a parking position.

The inventive design allows, in embodiments, to achieve relevant advantages over the prior art designs.

For example, the provision of two pairs of elevator arms allows to disassemble and assemble an elevator to the pair of elevator arms at the parking position, while the other pair of elevator arms supports the elevator in an operational position. This is advantageous when different types of elevators are required in a process, in particular when switching between types of elevators is required. The embodiment with two pairs of elevator arms, each adapted to support an elevator, allows an efficient switch between two types of elevators which may attribute to the overall process efficiency.

This aspect of the invention can be applied independently from the first aspect of the invention, or applied in combination with the first aspect of the invention.

The present invention further relates to a method for performing a well drilling operation, wherein use is made of the inventive installation according to the attached claims.

In particular, the invention relates to a method wherein use is made of an installation according to claim 1 wherein the top drive is suspended in a detachable manner, the method comprising the following steps:

- well drilling by the top drive unit,
- detaching the drill string from the tubular stem,
- attaching the drill string to the elevator,
- detaching the top drive,
- tripping the drill string.

The invention further relates to a method wherein use is made of an installation according to claim 1 wherein the top drive is suspended in a detachable manner, and wherein a rotary table is provided to hang off the drill string, and wherein a substitute top drive is provided, the method comprising the following steps:

- well drilling by the top drive unit,
- hanging off the drill string in the rotary table,
- detaching the top drive,
- replacing the top drive by the substitute top drive.

It is noted that alternative clamps and the like may be applied to hang of the drill string. It is conceivable that the top drive is lifted upwards through the trolley, by a crane or the like. It is also possible that the top drive is lowered onto a standard or the like when the elevator and elevator support assembly have moved in an upward direction. Hence, such an installation allows for an easy replacement of a top drive, when required. It is conceivable that the step of detaching the top drive is not followed by the replacement of the top drive, but that alternative drilling operations may follow, not requiring a top drive. In an embodiment, as elucidated below with respect to FIG. 10*b*, such an operation may include the use of mud hoses and a tubular stem, wherein the top drive has thus been removed.

The invention also relates to a method wherein use is made of an installation according to claim 16, comprising the following steps:

- well drilling by the top drive unit,
- detaching the drill string from the tubular stem,
- positioning a first pair of pivotal elevator arms supporting a first elevator in the operative position and positioning the second pair of elevator arms in a parking position,
- attaching the drill string to the first elevator,
- detaching the top drive,
- tripping the drill string,
- attaching a second elevator to the second pair of elevator arms in the parking position.

The invention is further explained in relation to the drawings, in which.

Figure 9:
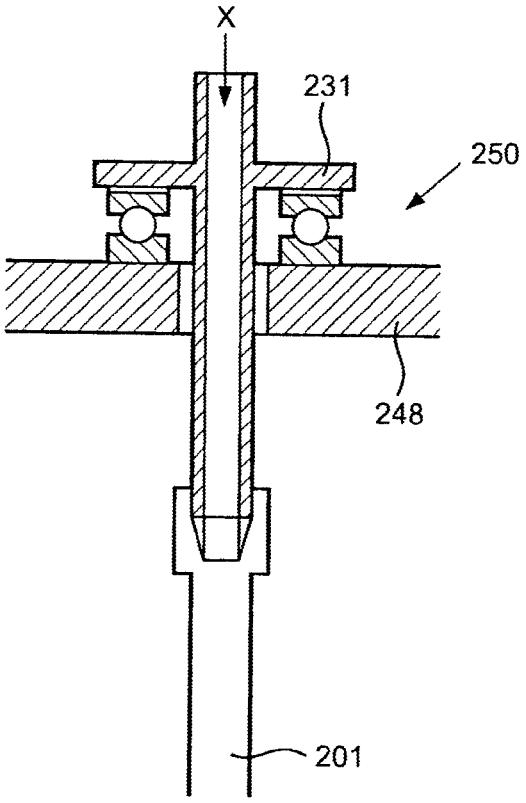
Figure 10A:
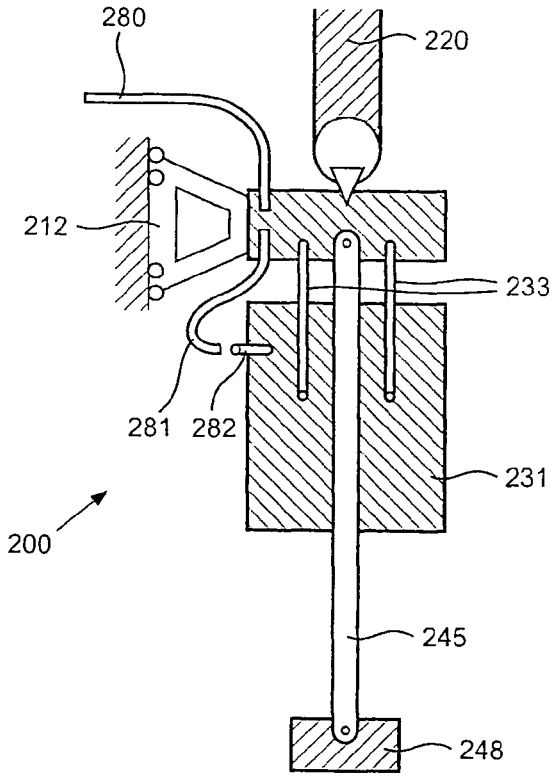
Figure 10B:
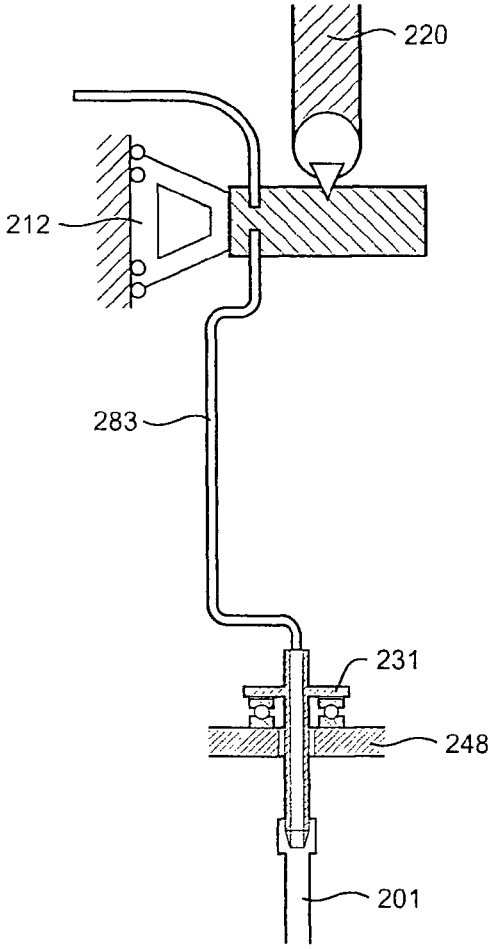

FIG. 9 schematically shows a detail of an embodiment of a tubular stem of a top drive well drilling installation in a cross-sectional view;

FIGS. 10*a* and 10*b* schematically show a third embodiment of a top drive well drilling installation in a side view.

Figure 1:
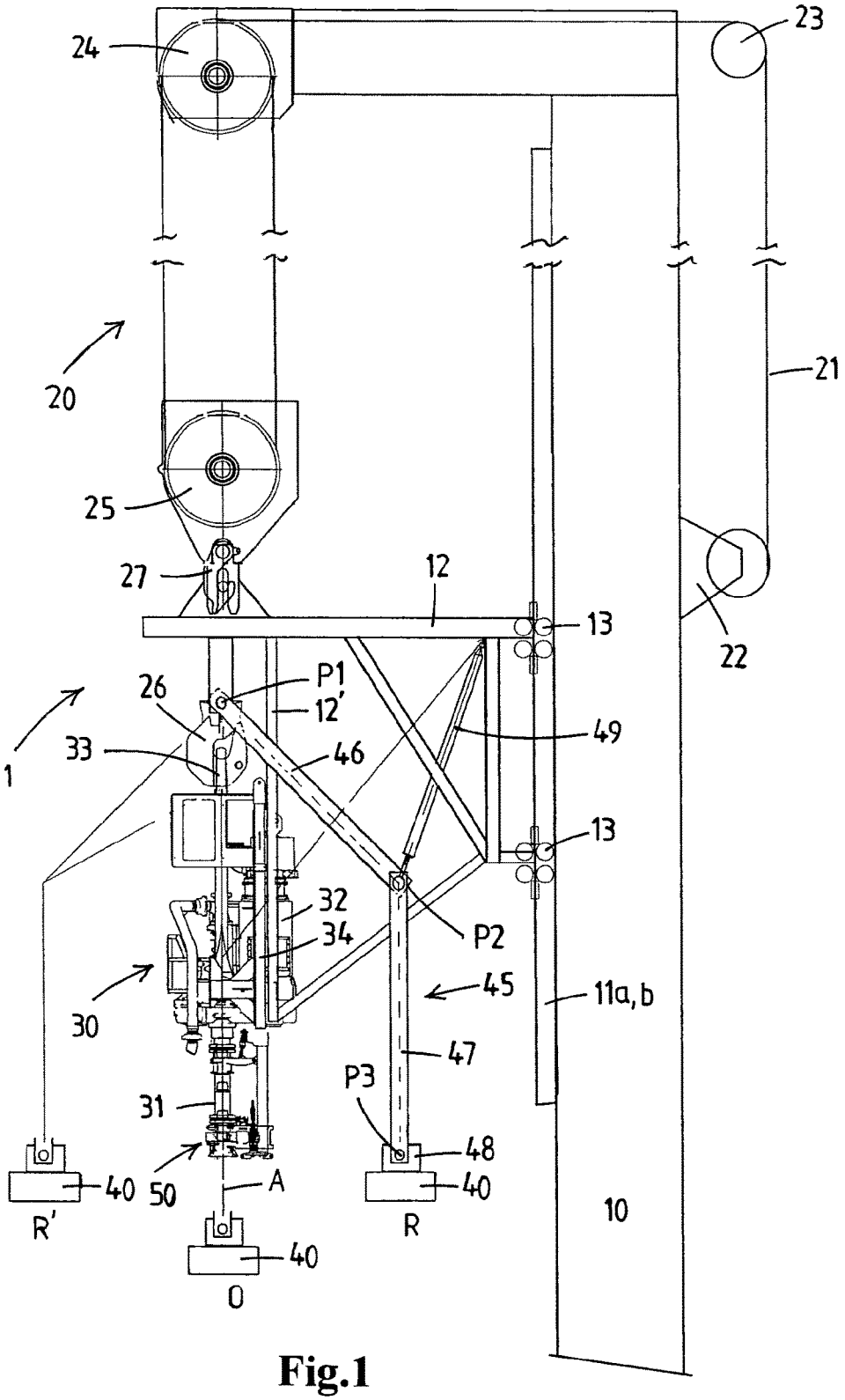
FIG. 1 shows a first embodiment of a top drive well drilling installation in a side view.
Figure 2:
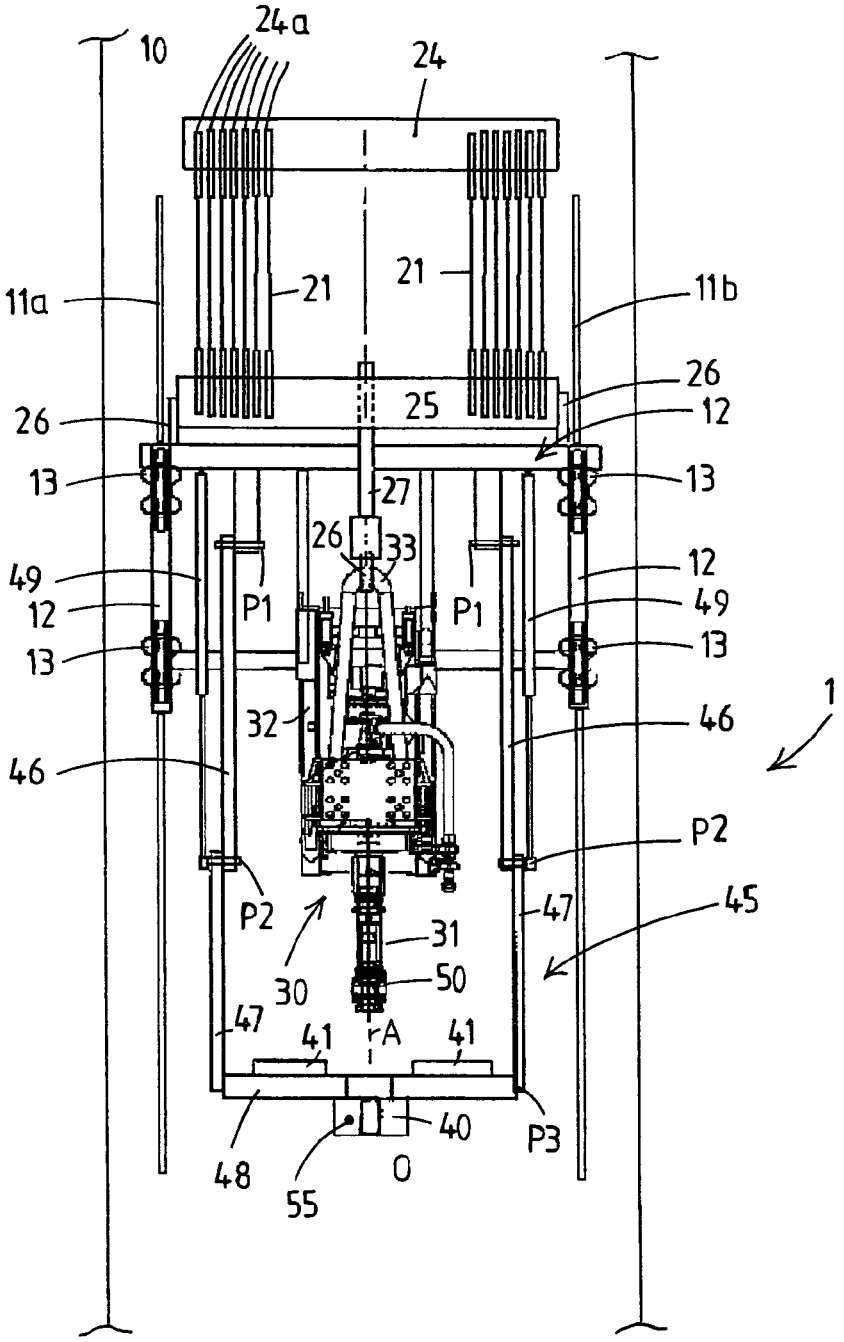
FIG. 2 shows the top drive well drilling installation of FIG. 1 in a front view.

In FIGS. 1 and 2 a top drive well drilling installation 1 according to the first aspect of the present invention is shown in a side and a front view, respectively.

In the drawings, schematically a portion of a drilling tower 10 is shown, and two vertical rails 11*a*, 11*b* which are supported by the drilling tower 10. A trolley 12 is guided along said vertical rails 11*a*, 11*b*, via guide wheel sets 13.

The top drive well drilling installation 1 is furthermore provided with a hoisting device 20, comprising a cable 21 and a winch 22. The cable 21 extends from the winch, via one or more pulleys 23 at the top of the drilling tower 10 to a crown block 24 and a travelling block 25. The crown block comprises multiple sheaves 24*a*, mounted on a common axle. The travelling block 25 is suspended from the crown block 24 by said cable 21. The trolley 12 is suspended via connectors 26 at the ends of the travelling block 25 so as to move up and down upon operation of the winch 22.

In a not shown embodiment, the top drive well drilling installation is furthermore provided with a top drive hoisting device, adapted to suspend the top drive and remove the top drive from the operative position on the drill string axis. To this end, the crown block 24 and travelling block 25 may be of a U-shaped construction wherein the cables 21 extend between the legs of the U, and wherein a top drive hoisting device is allowed to enter the drill string axis via the opening of the U between the legs, to engage the top drive within the drill string axis.

The top drive well drilling installation 1 is furthermore provided with a top drive unit 30 including a tubular stem 31 to be connected to the upper end of a drill string (not shown) for rotation therewith about an axis A of the drill string, and including a motor 32 adapted to rotate the tubular stem 31 and thereby the connected drill string to drill a well. The travelling block 25 supports a hook 26, and the top drive unit 30 is provided with a bail 33 so as to suspend the top drive unit from the hook 26. The hook 26 is directly connected to the travelling block 25 via a connector 27. The top drive unit 30 is supported by a top drive frame 34, where the trolley 12, in particular trolley portion 12', absorbs reaction torque from the motor 32 of the top drive unit 30.

An elevator 40 is provided which is adapted to suspend the drill string, e.g. when detached from the tubular stem 31 of the top drive unit 30, e.g. during tripping. An elevator support assembly 45 is adapted to absorb the load of the suspended drill string and adapted to move the elevator 40 between the operative position on the drill string axis and a retracted position. In FIG. 1 a retracted position R of the elevator support assembly 45 is shown, where the elevator support assembly 45 is retracted in the direction of the rails 11*a, b*. The position of the elevator 40 in its operative position O, where the elevator is in line with the axis A of the drill string, is also visible in FIG. 1. An alternative retracted position R' of the elevator 40, away from the rails, is also indicated. In FIG. 2, the elevator 40 is shown in its operative position O.

According to the present invention, the elevator support assembly 45 is embodied as a direct drill string load bearing connection between the elevator 40 and the trolley 12, independent from the top drive unit 30.

The elevator support assembly 45 comprises two pivotal first arms 46, connected at an upper end thereof to the trolley 12 via pivot axis P1. The first arms 46 are arranged on opposed sides of the top drive unit 30 so as to pass along the top drive unit 30 when moving the elevator between the operative position O and a retracted position R or R'. In the shown embodiment, the elevator support assembly 45 comprises two pivotal second arms 47, each connected at an upper end thereof pivotally about pivot axis P2 to a lower end of a corresponding first arm 46. A cross beam 48 is pivotably connected via pivot axis P3 to the lower ends of the second arms 47. Said cross beam 48 supports the elevator 40. In the shown embodiment, the second arms 47 are freely rotatable suspended at their upper end so as to hang down under influence of gravity. Two elevator storage locations 41 are provided on the cross beam 48 at opposite sides of the elevator 40.

In the operative position O of the elevator 40 the interconnected first and second arms 47, 48 of each pair of arms are aligned on a vertical line below the upper pivot P1 of the first arm, the straight line being in a common imaginary plane with the drill string axis A.

The elevator support assembly 45 comprises one or more actuators 49, e.g. hydraulic cylinders, between the trolley and one or more of the pivotal arms, e.g. between each first arm and the trolley.

A wrench device 50 is connected to the top drive unit 30 for making and breaking connections between the tubular stem 31 and the drill string. Preferably the wrench device 50 is adapted for horizontal and vertical motion relative to the tubular stem 31.

The elevator 40 comprises at least one mobile elevator body member (not shown in detail) so as to cause an opened and closed state of the elevator, wherein—in the opened state—the elevator can be placed about a section of drill string or drill pipe and removed therefrom, and wherein—in the closed state—the elevator engages on the drill string or drill pipe so as to suspend said drill string or drill pipe from the elevator. The elevator 40 comprises a sensor 55 indicating the opened and/or closed state of the elevator, and wherein a sensor cable (not shown per se) is provided that extends along the elevator support assembly 45 to the trolley 12. It is highly preferred that not only the state of the elevator, but also the engagement of a drill pipe is monitored by a sensor.

In FIGS. 3-7 a second embodiment of a top drive well drilling installation 100 according to the first and second aspect of the present invention is shown in a front and rear perspective view, and in a non-operational position. As the drawings relate to the same embodiment, same parts are indicated with same reference numerals.

In FIGS. 3-7, the drilling tower and vertical rails supported by the drilling tower are not shown. However, a trolley 112 that is to be guided along said vertical rails is shown, comprising guide wheel sets 113.

The top drive well drilling installation 100 is furthermore provided with a hoisting device (not shown) for moving the trolley 112 up and down. It is visible that the trolley 112 is suspended from a travelling block 125 so as to move up and down. In particular, trolley 112 is provided with an upper frame part 112*a*, protruding horizontally away from the vertical rail, which in the shown embodiment is provided with connectors to connect sheaves 125*a* of the travelling block 125, here embodied as a splittable block, as commercially available from the applicant and described previously e.g. in U.S. Pat. No. 6,926,103.

The top drive well drilling installation 100 is furthermore provided with a top drive unit 130. In this embodiment, a tubular stem 131 is formed integral with the top drive unit 130, which tubular stem 131 is to be connected to the upper end of a drill string (not shown) for rotation therewith about an axis A of the drill string. The top drive unit 130 includes a motor to rotate the tubular stem 31 and thereby the connected drill string to drill a well.

In an alternative embodiment, shown schematically in FIG. 9, tubular stem 231 is connected to the upper end of a drill string 201 for rotation therewith. Here, tubular stem 231 is supported via a thrust bearing 250 by an elevator support assembly. Here, the thrust bearing 250 is supported by an essentially horizontal cross beam 248 of the elevator support assembly, which is suspended freely pivotable to the lower ends of pivotal first arms, similar to the horizontal cross beam 148 in FIGS. 3-7. The thrust bearing 250 allows the tubular stem 231 to rotate, e.g. by a torque generating device. The tubular stem 231 is to be rotated by a top drive unit, in particular by lowering a torque transmitting pin of the top drive unit into the tubular stem, e.g. by a cylinder 130*a* as described in relation to FIGS. 3-7, and as will be described below.

It is noted that in the embodiment of FIGS. 3-7, where the drill string is suspended from the top drive unit, the top drive unit supports the drill string, and needs thus be provided with a thrust bearing. In the embodiment of FIG. 9, an alternative top drive unit may be provided without such a thrust bearing.

In FIGS. 3-7 it is visible that upper frame part 112*a* of the trolley 112 is provided with eyelets for a pin 126, adapted to support bails 133*a* and 133*b* of the top drive unit 130, so as to suspend the top drive unit 130 from the hook trolley 112. In particular in FIG. 5, it is visible that the top drive unit 130 is supported by a top drive frame 134, where the trolley 112 absorbs reaction torque from the motor of the top drive unit 130. At the upper part of top drive unit 130, a cylinder 130*a* is provided connecting the top drive unit 130 with the upper frame part 112*a* of the trolley. This cylinder 130*a* is provided to lift the top drive unit 130 with respect to the trolley 112, when removal of the top drive unit 130 is envisaged and the bails 133*a*, 133*b* need to be removed from the pin 126. The cylinder 130 may also be used to lower a torque transmitting pin of the top drive unit into the tubular stem, as described above.

Elevators 140*a*, 140*b* are provided, which are adapted to suspend the drill string, casing etc. etc., when detached from the tubular stem 131 of the top drive unit 130, e.g. during tripping.

Figure 5:
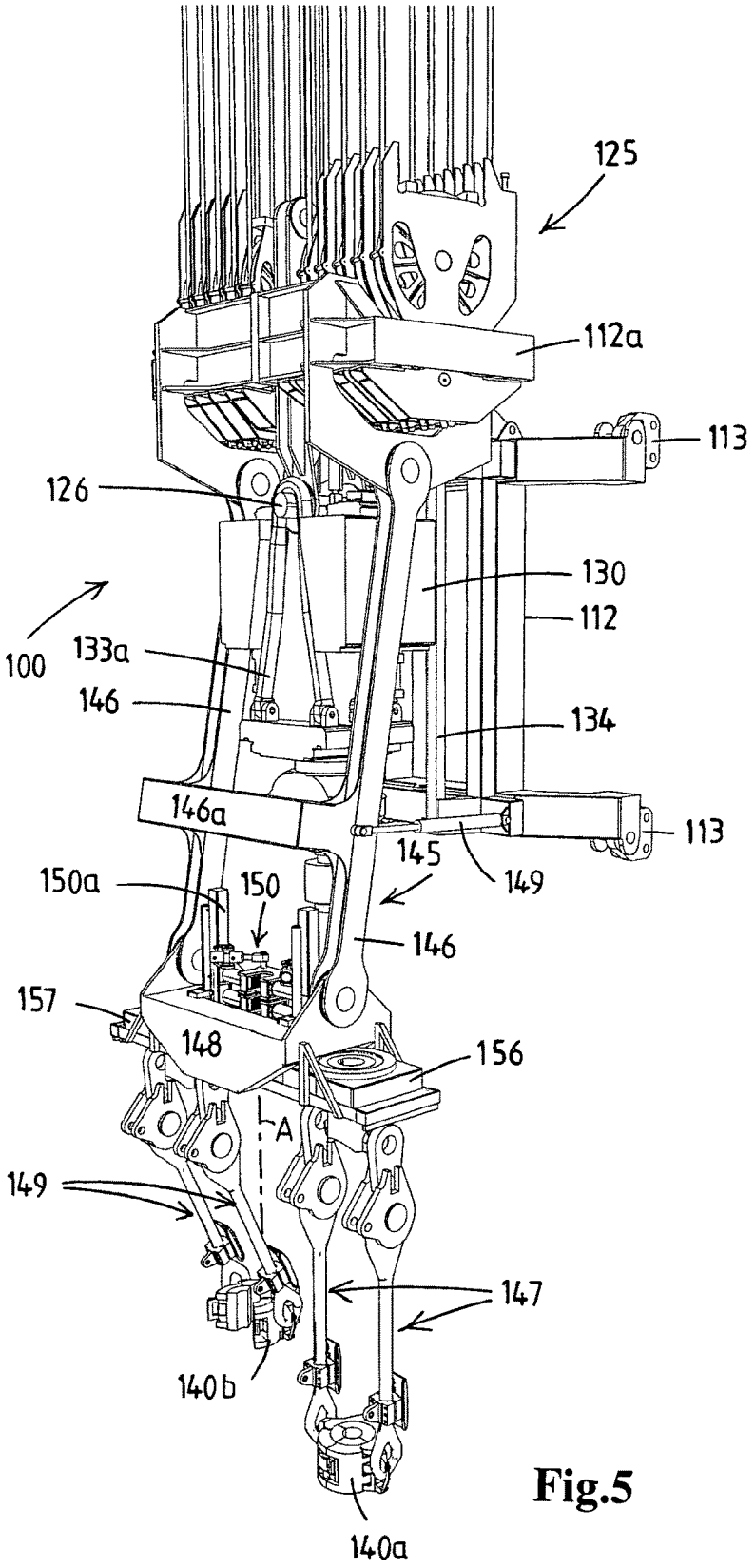
FIG. 5 shows the second embodiment of FIGS. 3 and 4 in a non-operational position in a perspective front view.

The elevators 140*a*, 140*b* are supported by an elevator support assembly 145, which is adapted to absorb the load of the suspended drill string, casing or the like, and which is adapted to move the elevator 140 between an operative position on the drill string axis A and a retracted position. In FIG. 5 a retracted position of the elevator support assembly 145 is shown, wherein the elevator support assembly 145 is retracted away from the rails of the trolley 112. The elevator support assembly 145 comprises one or more actuators 149, e.g. hydraulic cylinders, between the trolley 112 and the first pivotal arms 146, to move the elevator support assembly between the operative position and a remote position.

In FIGS. 3, 4, 6 and 7, the elevator support assembly 145 is shown in an operative position.

According to the present invention, the elevator support assembly 145 is embodied as a direct drill string load bearing connection between the elevators 140*a*, 140*b* and the trolley 112, independent from the top drive unit 130.

In the embodiment of FIGS. 3-7, the elevator support assembly 145 comprises two pivotal first arms 146, connected at an upper end thereof to the trolley 12 via pivot axis R1. The first arms 146 are arranged on opposed sides of the top drive unit 130 so as to pass along the top drive unit 130 when moving the elevator support assembly 145 between the operative position of FIGS. 3 and 4, and the retracted position as shown in FIG. 5. Here, the first arms 146 are interconnected at an intermediate lever via a connection beam 146*a*.

It is noted that in the retracted position of the pivotal first arms 146 of FIG. 5, it is possible to detach and lower the top drive to a standard, e.g. for maintenance, replacement with another top drive, or simply because it is redundant for the operations that follow.

In the embodiment of FIGS. 3-7, the elevator support assembly 145 further comprises an essentially horizontal cross beam 148, which is suspended freely pivotable about pivot axis R2 to the lower ends of the pivotal first arms 146.

Figure 8:
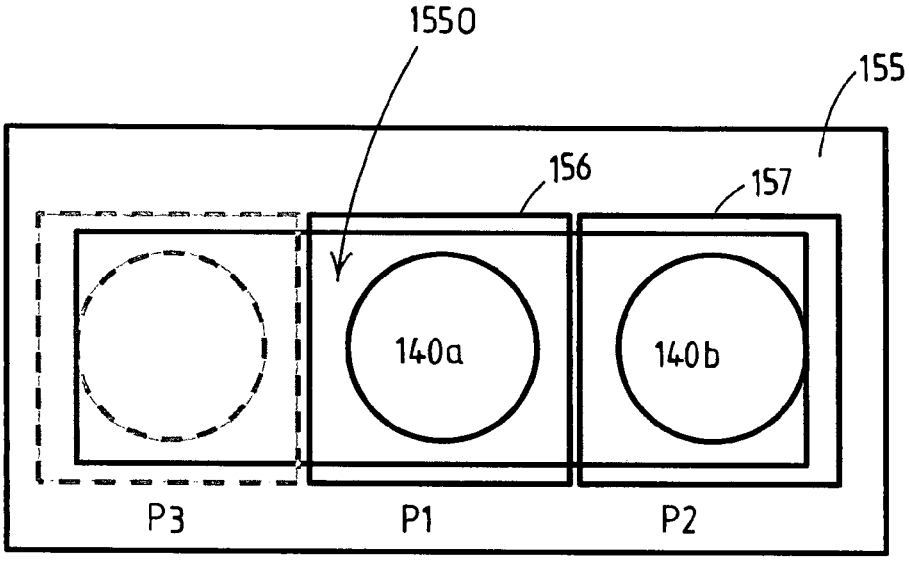
FIG. 8 shows an enlarged view of an elevator support plate, as provided in the second embodiment of the invention.

In the shown embodiment, an elevator support plate 155 is connected to the cross beam 148, which is provided with an opening 1550. The elevator support plate 155 is shown in an enlarged view in FIG. 8. In the opening, two elevator support blocks 156, 157 are provided that are provided with an opening, and from each of which a pair of pivotal elevator arms 147, 149 respectively, supporting the elevators 140*a*, 140*b* respectively, are suspended. Optionally, the elevators with the elevator arms are allowed to rotate about a vertical axis within the elevator support blocks. In the shown embodiment, the elevator support blocks 156, 157 are movable within the opening in the elevator support plate 155, between an operative position P1, a first parking position P2 and second parking position P3. Possibly, cylinders are provided to actuate the movement of the elevator support blocks 156, 157. Drag chains are preferably provided to control and provide power to the elevators.

Figure 4:
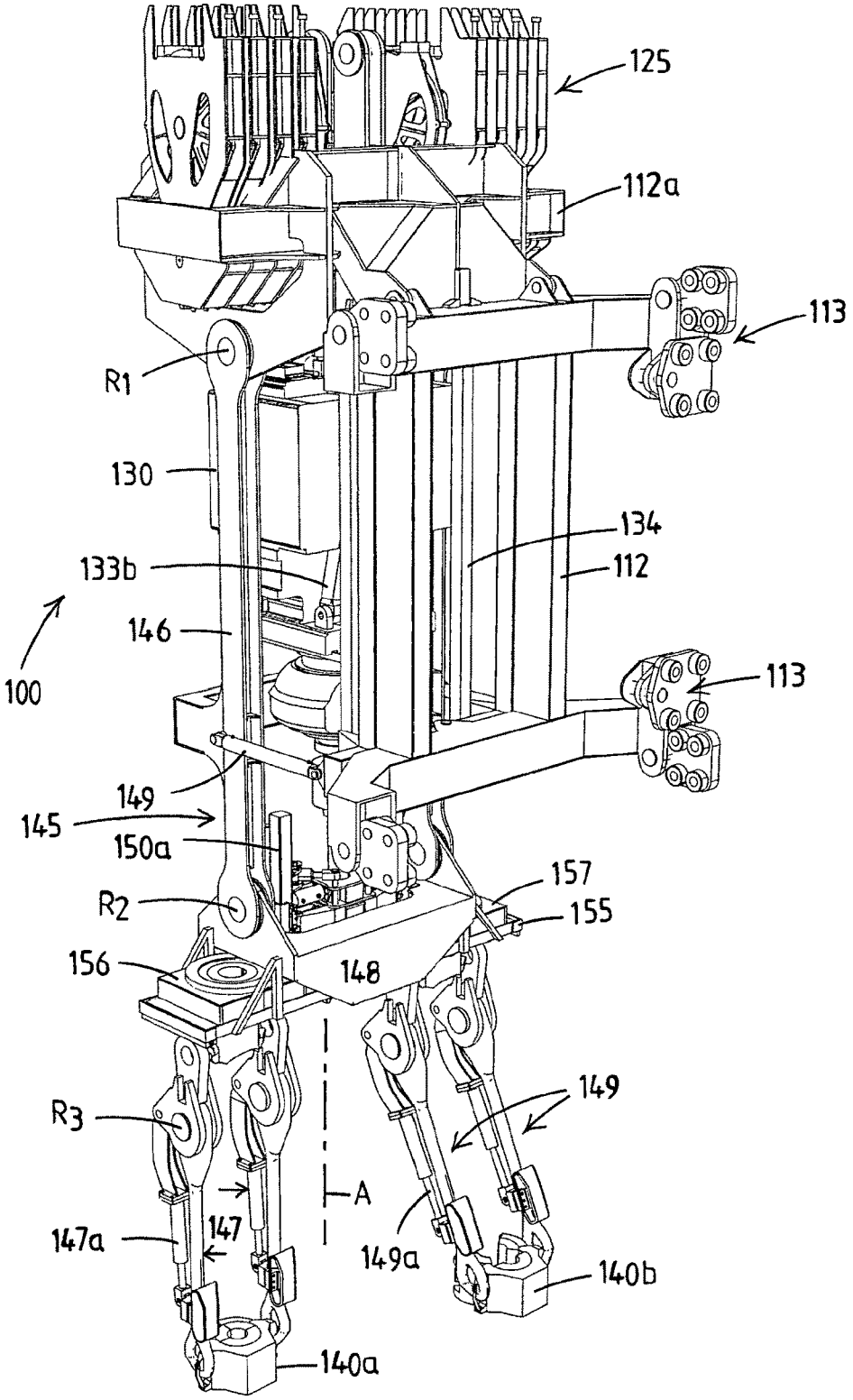
FIG. 4 shows the second embodiment of FIG. 3 in a perspective rear view.
Figure 6:
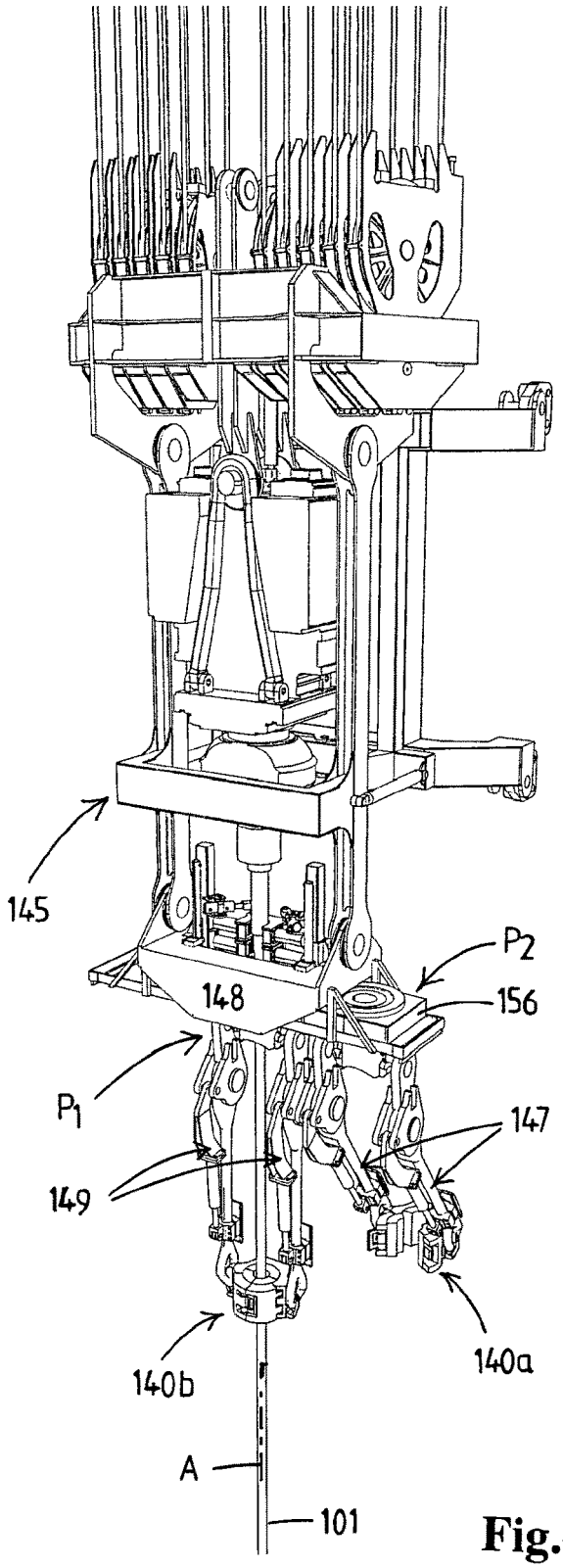
FIG. 6 shows the second embodiment of FIG. 3 in a perspective front view, wherein a drill string is suspended from an elevator supported by a first pair of elevator arms in the operative position, and wherein a second pair of elevator arms is positioned in a parking position.
Figure 7:
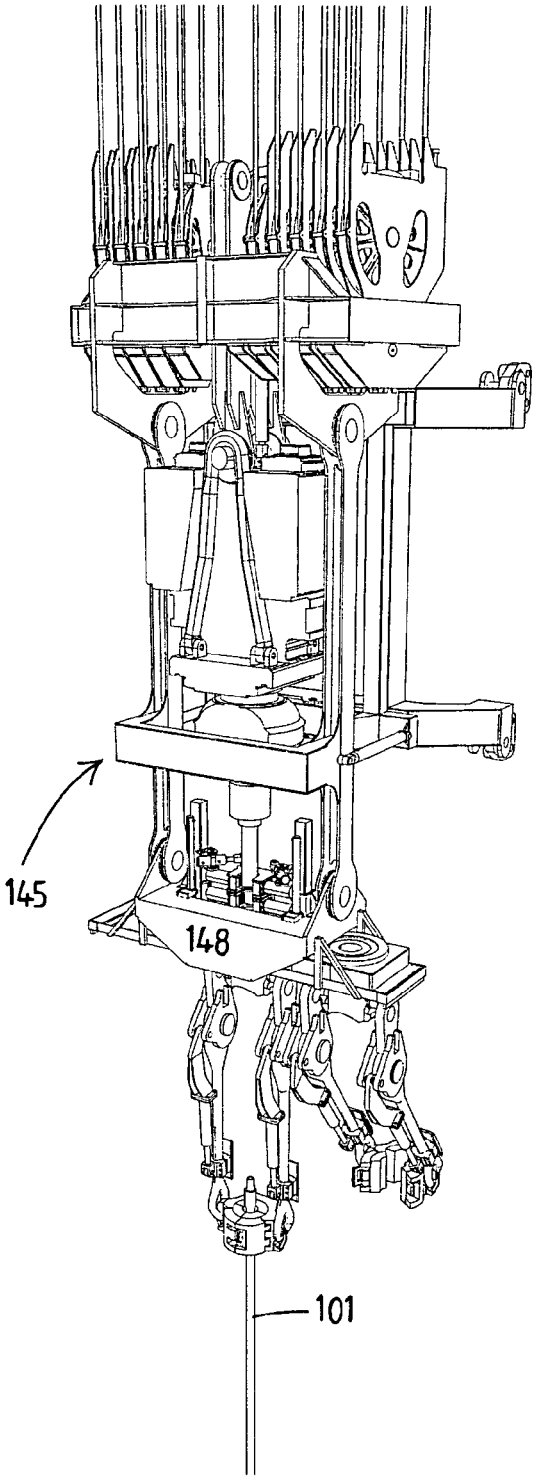
FIG. 7 shows the embodiment of FIG. 6, wherein the drill string is disconnected from the tubular stem.

In FIGS. 4 and 5, the elevator support blocks 156, 157 are shown at their parking positions P3 and P2, at the end positions of the plate 155. In FIGS. 6 and 7 the elevator support block 156 with a pair of elevator arms 147 is provided at parking position P2, while elevator support block 157 is not visible, as it is positioned with its elevator arms 149 and elevator 140*b* in the operative position. The elevator arms 149 are aligned on a vertical line in a common imaginary plane with the drill string axis A of drill string 101, and the elevator 140*b* is aligned with the drill string axis A.

In the shown embodiment, the cross beam 148 is provided with a wrench device 150 for making and breaking connections between the tubular stem 131 and the drill string. In the shown embodiment, the wrench device 150 is adapted for horizontal and vertical motion relative to the tubular stem 131, allowing the cross beam 148 to move away from the operational position and away from the tubular stem 131. The vertical motion is enable by the provision of rails 150*a*. The wrench device 150 of the shown embodiment, as indicated in particular in FIG. 3, comprises an upper wrench 150' and a bottom wrench 150". The bottom wrench 150" clamps the drill string, providing torque, while the upper wrench 150' turns the tubular stem. As a result of this configuration of a wrench device, the top drive is not required to provide a connection between the tubular stem and the drill string.

The pivotal elevator arms 147, 149 are each adapted to support an elevator 140*a*, 140*b*. In the operative position of elevator 140*b* as shown in FIGS. 6 and 7—the corresponding pair of elevator arms is aligned on a vertical line in a common imaginary plane with the drill string axis A of drill string 101 and the elevator is aligned with the drill string axis, while the other pair of elevator arms is positioned in a parking position. In particular, the pivotal elevator arms 147, 149 are each connected at an upper end thereof pivotally about pivot axis R3 to the elevator support blocks 156, 157. To assist in the alignment process, in particular to bring drill pipes, casing etc. in line with the axis A of the drill string 101, hydraulic cylinders 147*a*, 149*a* are applied adjacent the elevator arms 147, 149.

Figure 3:
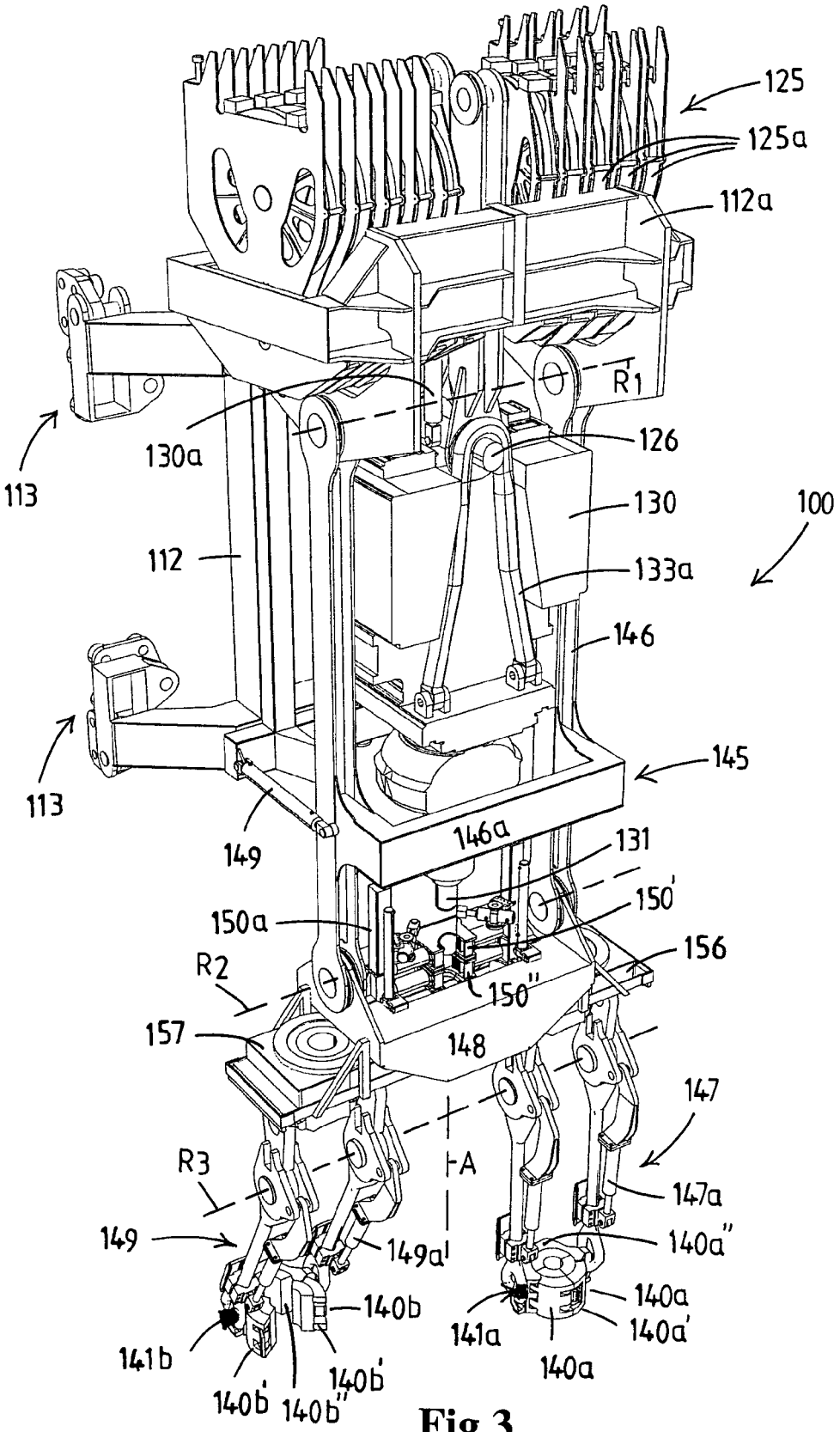
FIG. 3 shows a second embodiment of a top drive well drilling installation in a perspective front view.

The shown elevators 140*a*, 140*b* each comprise mobile elevator body members so as to cause an opened and closed state of the elevator. In particular, mobile elevator members 140*b'* are mobile with respect to elevator member 140*b*", and mobile elevator members 140*a'* are mobile with respect to elevator member 140*a*". In FIGS. 3-5, elevator 140*b* is shown in the opened state, allowing the elevator 140*b* to be placed about a section of drill string or drill pipe and removed therefrom. In FIGS. 3-5, elevator 140*a* is shown the closed state, in which the elevator 140*a* is adapted to engage on a drill string or drill pipe (not shown) so as to suspend said drill string or drill pipe from the elevator 140*a*. In FIGS. 6 and 7, elevator 140*b* is shown in the closed state, placed about a section of drill string or drill pipe 101, while elevator 140*a* is shown the opened state.

The shown elevators 140*a*, 140*b* comprises a sensor 141*a*, 141*b* respectively for indicating the opened and/or closed state of the elevator, and wherein a sensor cable (not shown) is provided that extends along the elevator support assembly 146 to the trolley 112. Furthermore, preferably sensors are provided for indicating whether or not a tubular is held by the elevator.

In FIGS. 10*a* and 10*b*, components of a top drive well drilling installation 200 according to the invention are schematically represented, in particular a trolley 212, moveable up and down by a hoisting device 220, along rails supported by a drilling tower (both not shown). From the trolley, a top drive unit 231 is suspended via connectors 233. The top drive includes a motor adapted to rotate the tubular stem and thereby the connected drill string to drill a well, wherein the top drive unit is supported by the trolley, at least so as to absorb reaction torque from the motor of the top drive unit. According to the invention, an elevator support assembly 245 is provided between an elevator (not shown) and the trolley 212, independent from the top drive unit 231. Accordingly, removal of the top drive unit 231 is possible, without disassembling the elevator.

A mud hose 280, also referred to as a Kelly hose, is provided to supply mud, eventually to the drill string. Similarly, not shown, supply lines for electronics, control signals and hydraulics are provided. Conventionally, electronics, control signals and/or hydraulics are supplied directly to the trolley 212, and in parallel, electronics, control signals, hydraulics and/or mud are supplied to the top drive unit 231.

In the embodiment of FIGS. 10*a* and 10*b*, according to a preferred aspect of the invention, the mud hose 280 is only connected to trolley 212. Similarly, other supply lines for electronics, control signals and hydraulics may also be connected to the trolley 212 alone, e.g. via a drag chain or the like. The electronics, control signals, hydraulics and/or mud are subsequently transferred to the top drive unit 231 via a jumper. Here, a mud jumper 281 is shown in FIG. 10*a*, transferring mud from the trolley 212 to a conventional mud connector 282 on the top drive unit 231.

This mud jumper 281 can be disconnected from the top drive unit 231 upon removal of the top drive unit 231, while mud hose 280 remains connected to the trolley 212. This is advantageous e.g. during maintenance of the top drive, or when an alternative top drive is to be installed, or when the trolley and elevator are used for purposes not requiring a top drive.

For example, in the situation shown in FIG. 10*b*, similar to the configuration of FIG. 9, a tubular stem 231 may be supported via a thrust bearing 250 to the elevator support assembly 245, in particular to an essentially horizontal cross beam 248 thereof. In this configuration, the mud may be transferred via an elongated mud jumper 283 directly to the tubular stem 231.

Alternatively, not shown, the upper end of a drill string is supported by a clamp, which is supported by an essentially horizontal cross beam of the elevator support assembly, which is suspended freely pivotable to the lower ends of pivotal first arms, similar to the horizontal cross beam 148 in FIGS. 3-7 and cross beam 248 as shown in FIGS. 9 and 10. The clamp is preferably a rotatable clamp that allows the drill string to rotate, e.g. by a torque generating device. As such, it is conceivable that both the top drive and the tubular stem are removed, and that similar to the situation shown in FIG. 10*b*, mud may be transferred via an elongated mud jumper directly to the upper end of the drill string.

The invention claimed is:

1. A top drive well drilling installation, comprising:

a drilling tower;

one or more vertical rails supported by the drilling tower;

a trolley guided along said one or more vertical rails;

a hoisting device for moving the trolley up and down;

a tubular stem which is to be connected to the upper end of a drill string for rotation therewith about an axis of the drill string;

a top drive unit including a motor adapted to rotate the tubular stem and thereby the connected drill string to drill a well, wherein the top drive unit is supported by the trolley, at least so as to absorb reaction torque from the motor of the top drive unit;

an elevator adapted to—in an operative position—suspend the drill string; and an elevator support assembly adapted to absorb the load of the suspended drill string and adapted to move the elevator between the operative position on the drill string axis and a retracted position, wherein the elevator support assembly is a direct drill string load bearing connection between the elevator and the trolley, independent from the top drive unit, and wherein the elevator support assembly comprises two pivotal first arms connected at an upper end thereof to the trolley, the first arms being arranged on opposed sides of the top drive unit so as to pass along the top drive unit when moving the elevator between the operative and retracted position.

2. The top drive well drilling installation according to claim 1, wherein the elevator support assembly comprises two pivotal second arms, each connected at an upper end thereof pivotally to a lower end of a corresponding first arm, wherein the elevator is connected to a lower end of the second arms.

3. The top drive well drilling installation according to claim 2, wherein a cross beam is connected to the lower ends of the second arms, said cross beam supporting the elevator.

4. The top drive well drilling installation according to claim 3, wherein the second arms are freely rotatably suspended at their upper end so as to hang down under influence of gravity.

5. The top drive well drilling installation according to claim 2, wherein—in the operative position of the elevator—the interconnected first and second arms of each pair of arms are aligned on a vertical line below the upper pivot of the first arm, the straight line being in a common imaginary plane with the drill string axis.

6. The top drive well drilling installation according to claim 1, wherein the two pivotal first arms are mutually connected.

7. The top drive well drilling installation according to claim 6, wherein the two pivotal first arms are mutually connected via one or more cross beams forming a U-shaped cage surrounding the top drive unit.

8. The top drive well drilling installation according to claim 1, wherein a cross beam is connected to the lower ends of the pivotal first arms, to which cross beam a pair of pivotal elevator arms supporting the elevator is connected.

9. The top drive well drilling installation according to claim 8, wherein the cross beam is freely rotatably suspended from the lower ends of the pivotal first arms so as to hang down under influence of gravity.

10. The top drive well drilling installation according to claim 8, wherein—in the operative position of the elevator—the first arms and elevator arms of each pair of arms are aligned on a vertical line below the upper pivot of the first arm, the straight line being in a common imaginary plane with the drill string axis.

11. The top drive well drilling installation according to claim 8, wherein the cross beam is essentially horizontal, and two pairs of pivotal elevator arms are movable along the cross beam between an operative position and a first and second parking position, the pivotal elevator arms each adapted to support an elevator, wherein—in the operative position of an elevator—the corresponding pair of elevator arms is aligned on a vertical line in a common imaginary plane with the drill string axis and the elevator is aligned with the drill string axis, while the other pair of elevator arms is positioned in a parking position.

12. The top drive well drilling installation according to claim 1, wherein the elevator support assembly comprises one or more actuators between the trolley and one or more of the pivotal arms.

13. The top drive well drilling installation according to claim 1, wherein the hoisting device supports a hook, and wherein the top drive unit is provided with a bail so as to suspend the top drive unit from the hook.

14. The top drive well drilling installation according to claim 1, wherein the elevator comprises at least one mobile elevator body member so as to cause an opened and closed state of the elevator, wherein—in the opened state—the elevator can be placed about a section of drill string or drill pipe and removed therefrom, and wherein—in the closed state—the elevator engages on the drill string or drill pipe so as to suspend said drill string or drill pipe from the elevator.

15. The top drive well drilling installation according to claim 14, wherein the elevator comprises a sensor indicating the opened and/or closed state of the elevator, and wherein a sensor cable is provided that extends along the elevator support assembly to the trolley.

16. The top drive well drilling installation according to claim 1, wherein a wrench device is connected to the top drive unit for making and breaking connections between the tubular stem and the drill string.

17. The top drive well drilling installation according to claim 16, wherein the wrench device is adapted for horizontal and vertical motion relative to the tubular stem.

18. The top drive well drilling installation according to claim 1, wherein the elevator support assembly is provided with one or more elevator storage locations.

19. The top drive well drilling installation according to claim 18, wherein at least two elevator storage locations are provided at opposite sides of the elevator.

20. The top drive well drilling installation according to claim 1, wherein the hoisting device comprises a cable and a winch, a crown block, and a travelling block suspended from the crown block by said cable, wherein the trolley is suspended from the travelling block so as to move up and down upon operation of the winch.

21. A method for performing a well drilling operation, comprising the step of using the top drive well drilling installation according to claim 1.

22. A method for performing a well drilling operation, wherein use is made of the installation according to claim 1, wherein the top drive is suspended in a detachable manner, the method comprising the steps of:

well drilling by the top drive unit;
detaching the drill string from the tubular stem;
attaching the drill string to the elevator;
detaching the top drive; and
tripping the drill string.

23. A method for performing a well drilling operation, wherein use is made of the installation according to claim 1, wherein the top drive is suspended in a detachable manner, wherein a rotary table is provided to hang off the drill string, and wherein a substitute top drive is provided, the method comprising the steps of:

well drilling by the top drive unit;
hanging off the drill string in the rotary table;
detaching the top drive; and
replacing the top drive by the substitute top drive.

24. A top drive well drilling installation, comprising:

a drilling tower;
one or more vertical rails supported by the drilling tower;
a trolley guided along said one or more vertical rails;
a hoisting device for moving the trolley up and down;
a tubular stem which is to be connected to the upper end of a drill string for rotation therewith about an axis of the drill string;
a top drive unit including a motor adapted to rotate the tubular stem and thereby the connected drill string to drill a well, wherein the top drive unit is supported by the trolley, at least so as to absorb reaction torque from the motor of the top drive unit;
an elevator adapted to—in an operative position—suspend the drill string; and
an elevator support assembly adapted to absorb the load of the suspended drill string and adapted to move the elevator between the operative position on the drill string axis and a retracted position, wherein the elevator support assembly comprises an essentially horizontal cross beam along which two pairs of pivotal elevator arms are movable between the operative position and a first and second parking position, the pivotal elevator arms each adapted to support an elevator, wherein—in the operative position of an elevator—the corresponding pair of elevator arms is aligned on a vertical line in a common imaginary plane with the drill string axis and the elevator is aligned with the drill string axis, while the other pair of elevator arms is positioned in one of the first and second parking positions.

25. A method for performing a well drilling operation, wherein use is made of the top drive well drilling installation according to claim 24, the method comprising the steps of:

well drilling by the top drive unit;

detaching the drill string from the tubular stem;

positioning a first pair of the pivotal elevator arms supporting a first elevator in the operative position and positioning a second pair of the elevator arms in one of the first and second parking positions;

attaching the drill string to the first elevator;

detaching the top drive;

tripping the drill string; and attaching a second elevator to the second pair of elevator arms in the one of the first and second parking position.

* * * * *